US005885407A

United States Patent [19]

Mossbeck

[11] Patent Number: 5,885,407

[45] Date of Patent: Mar. 23, 1999

[54] METHOD AND APPARATUS FOR FORMING POCKET SPRING COIL MATTRESSES

[76] Inventor: Niels S. Mossbeck, 2135 Manufacturers Rd., Dayton, Tenn. 37321

[21] Appl. No.: 639,977

[22] Filed: Apr. 29, 1996

[51] Int. Cl.[6] ..... B30B 15/04

[52] U.S. Cl. ..... 156/558; 156/556

[58] Field of Search ..... 156/556, 558

[56] References Cited

U.S. PATENT DOCUMENTS

| | | | |
|---|---|---|---|
| 3,633,228 | 1/1972 | Zysman | 5/353 |
| 3,720,966 | 3/1973 | Zysman | 5/353 |
| 4,401,501 | 8/1983 | Stumpf | 156/367 |
| 4,565,046 | 1/1986 | Stumpf | 53/114 |
| 4,907,309 | 3/1990 | Breckle | 5/477 |
| 5,126,004 | 6/1992 | Suenens et al. | 156/556 |
| 5,127,635 | 7/1992 | Long et al. | 267/91 |
| 5,699,998 | 12/1997 | Zysman | 267/189 |

*Primary Examiner*—Francis J. Lorin
*Attorney, Agent, or Firm*—Alan Ruderman; Miller & Martin LLP

[57] ABSTRACT

A method and apparatus for forming a mattress having a core formed from a plurality of elongated rows of interconnected coil spring containing fabric pockets, each row having a plurality of spaced apart pockets with a spring encased in each pocket and having an elastic strip of material between adjacent rows. A first row of spring encased pockets is placed in a tray in a horizontal position and held in the tray by fingers which engage the fabric of the pockets at the ends of each spring, there being a finger at each end of each pocket. The elastic strip of material may thereafter be bonded to the row and adhesive may be placed on the upper surface of the elastic material. The tray is mounted on a pivotable plate which is then rotated to a vertical position and moved linearly toward a table containing prior rows of the core to bond the elastic strip carried in the tray to the last row on the table. The fingers are thereafter removed from the row in the tray and the tray is pushed linearly a further distance to move the core on the table together with the newly bonded row further onto the table. The tray is thereafter moved linearly and rotated back to its initial position.

15 Claims, 5 Drawing Sheets

METHOD AND APPARATUS FOR FORMING POCKET SPRING COIL MATTRESSES

BACKGROUND OF THE INVENTION

This invention relates to a method and apparatus for forming a pocket-spring coil mattress having a plurality of rolls of closed interconnected fabric pockets, the pockets in each row individually encasing a respective spring, the rows being connected to other such rows separated by elastomeric material bonded between the rows, and more particularly to a method and apparatus for positioning, holding and bonding the pocket-spring rows to the elastomeric material and to other rows.

In Breckle U.S. Pat. No. 4,907,309, a mattress is disclosed having rows of closed fabric pockets with a coil spring positioned in each pocket, there being a plurality of pockets in each row and the rows being connected transversely relative to the direction of the rows by an elastic connecting wall adhesively bonded between each pair of rows. However, the method for forming the mattress is merely disclosed as applying adhesive to an endless strip of connecting wall and pressing an endless row of pockets onto the strip until the connection is made and hardening has occurred. The combination row is then divided transversely into rows of finite length and each such row is thereafter bonded to other rows. In Suenens et al U.S. Pat. No. 5,126,004, which does not utilize a connecting wall between the rows of springs, each row of springs is compressed by a pressure plate to hold and position them so that an adhesively coated row may be pushed against another such row. The use of such a pressure plate causes the pocket material to sag and results in a bulging in the center portion of the springs, which was pointed out earlier by Breckle as being a problem. A similar pocket coil mattress is disclosed in Long et al U.S. Pat. No. 5,127,635 but the springs in the pockets in each row are formed from a continuous length of wire so that adjacent springs are interconnected, albeit each pocket contains one to three springs. None of this known prior art, however, is directed toward a method and apparatus for manufacturing a pocket-coil mattress in an efficient and practical manner.

SUMMARY OF THE INVENTION

Consequently, it is a primary object of the present invention to provide a method and apparatus for manufacturing a pocket-coil mattress having rows of closed fabric pockets with a coil spring positioned in each pocket, each row having a plurality of pockets and the rows being connected transversely relative to the direction of the rows by an elastomeric connecting wall bonded between an adjacent pair of rows.

It is another object of the present invention to provide a method and apparatus for receiving a first row of pocket-coils, holding the row to permit bonding of a strip of elastomeric material longitudinally thereto, moving the row with the strip into position for the strip to be bonded to a second row, applying pressure between the first and second rows to bond the strip to the second row and repeating the process until a mattress formed from a plurality of rows is produced.

It is a further object of the present invention to provide an apparatus having a tray for receiving a row of pocket-coils comprising closed fabric pockets, each pocket containing a coil spring, and a pair of jaws movable from a position permitting the row of pocket-coils to be inserted between the jaws into the tray and removed therefrom to a position wherein the pocket-coils are held in position on the tray, the jaws including fingers which engage the fabric at aligned 180 degree opposite positions substantially aligned with the axis of each coil spring to thereby maintain the fabric on the exterior of each pocket taut against the coils of the springs to permit a good adhesive bond to be made between the exterior of the pocket and a wall between each pair of pockets.

Accordingly, the present invention provides a method and apparatus for constructing a pocket-spring-coil mattress having rows of a plurality of coil spring containing fabric pockets connected to a similar row with an elastomeric material between the rows and bonded to the pockets of both rows, the method comprising, inserting a row of pocket containing springs into a tray in a horizontally disposed position, holding the row in the horizontal position by engaging the fabric of each pocket with oppositely located fingers disposed substantially axially relative to the axis of the coil spring within the respective pocket to maintain the horizontally disposed surfaces of the fabric taut against the coils, applying adhesive to the upper exterior surface of the fabric and placing a strip of elastomeric material thereon to bond the strip thereto, rotating the tray to a vertical position and moving the tray horizontally to engage the elastomeric strip against an adhesive surface of a previous row on a table. The fingers are thereafter released from engagement with the fabric, the tray moved further over the table to push the composite rows further on the table in preparation for subsequent rows, and the tray moved back and rotated to its initial position.

To perform the method of the present invention, the apparatus utilizes a tray preferably having a plurality of pocket-coil receiving surfaces for supporting a row of coil spring containing fabric pockets and a pair of spaced apart jaws associated with the tray, the jaws having a plurality of fingers and being movable from a position permitting a row of pocket-coils to be inserted into the tray to a position wherein the fingers engage the fabric of each pocket at dispositions substantially along the axis of each respective coil, each jaw having fingers aligned with respective fingers of the other jaw so that the fabric is maintained taut while the row of pocket-coils is held within the tray. Additionally, other aspects of the invention include apparatus for rotating the tray from a pocket-coil row receiving position to a position for securing the row in the tray to a previous row in seriatim so as to form the core of a mattress having pocket-coil springs.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
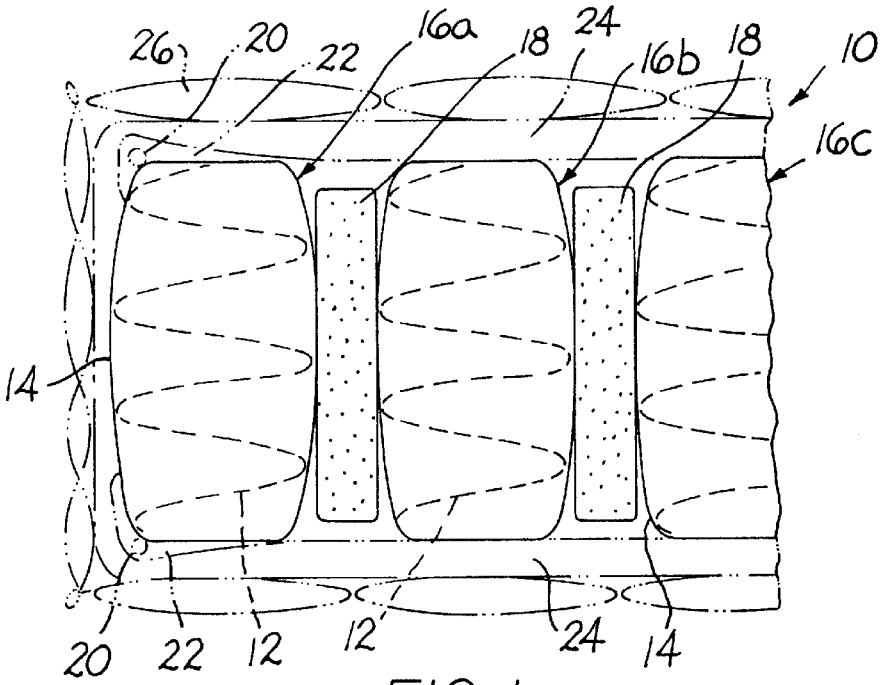
FIG. 1 is a fragmentary vertical cross sectional view taken substantially through a longitudinal section of a pocket-spring coil mattress constructed in accordance with the present invention.
Figure 2:
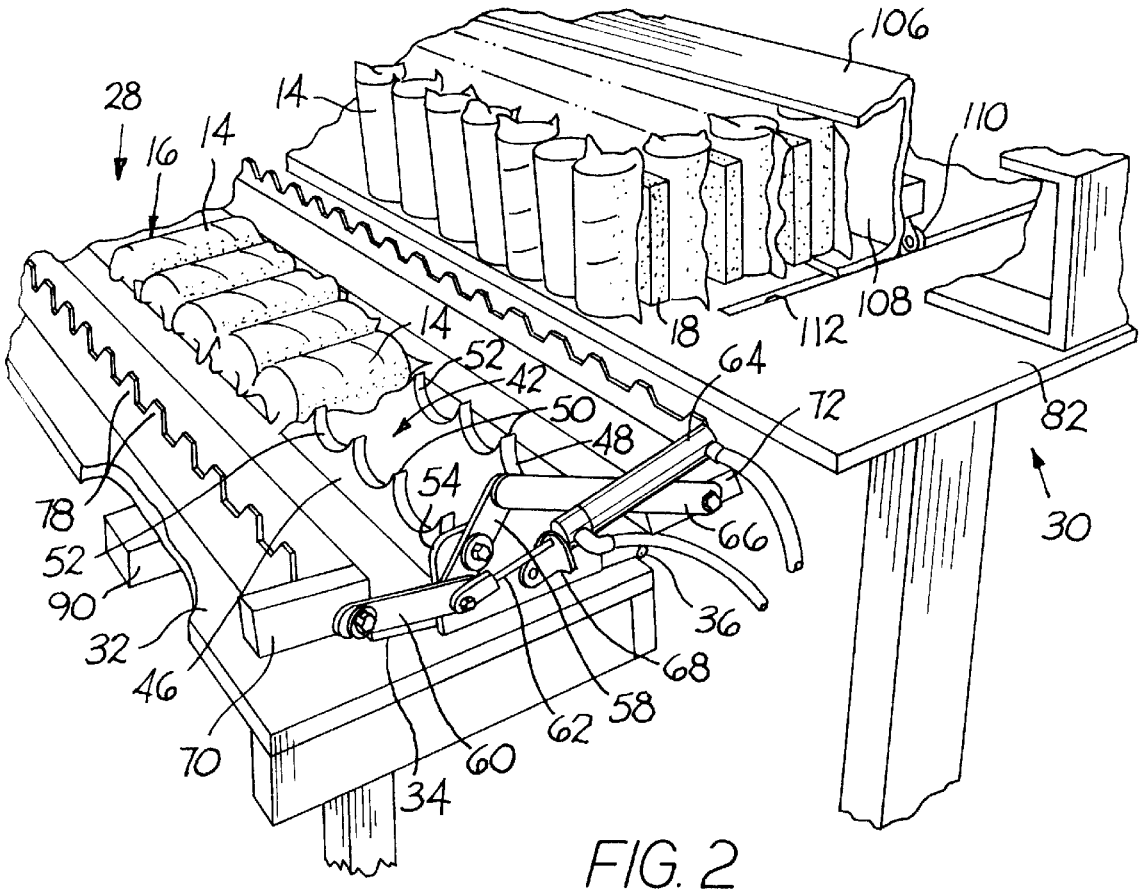
FIG. 2 is a fragmentary perspective view of a portion of the apparatus of the present invention.

Referring to the drawings, a portion of a pocket-spring coil mattress 10 is illustrated in FIG. 1 wherein coil springs 12 are each depicted positioned within a respective one of a plurality of pockets 14 forming respective rows of pockets 16, also illustrated in FIG. 2, the rows of pockets being connected to and separated by a strip of elastomeric material such as polyurethane foam 18. The pockets 14 forming a row comprise a strip of fabric, which may be a non-woven or a woven material, of a width somewhat larger than approximately twice the height of each coil spring 12, the strip being folded in half to form individual pockets for receiving the springs. The strip of material is sewn between adjacent pockets and along the open unfolded edges after the springs are inserted to lock the springs therein. As aforesaid, a mattress of this construction is disclosed in U. S. Pat. No. 4,907,309. Additionally, the finished mattress includes border rods 20 extending about the top and bottom edges over which a strip of felt or the like 22 is affixed. Braces, not illustrated, secure the top border rods to the bottom border rods while pads 24 about the top, bottom and sides covered by upholstered covering material 26 complete the mattress.

As illustrated in FIG. 2, the apparatus for constructing the core of the mattress comprises a first station 28 and a second station 30. A table 32 at the first station 28 pivotally mounts a plate 34 to permit the plate to pivot about hinges 36 spaced along the table. One or more piston rods 38, illustrated in FIG. 3, driven by respective cylinders 40 or other force applying means, is connected to the plate 34 in central portions extending upwardly through respective openings in the table 32 to pivot the plate 34 selectively about the hinges 36. Secured to the plate 34 is an elongated tray 42, the tray having a central portion 44 and a pair of oppositely disposed spaced apart elongated teeth-like sides 46, 48, the spacing being substantially equal to the length of a coil in a pocket. Each side 46, 48 carries a plurality of spaced apart projections 50 connected together by concave surfaces 52 of substantially circular form. The projections 50 on the side 46 are aligned with those of the side 42 so that a row of spring enclosed pockets may be positioned in the tray 42 with the individual pockets supported snugly on the surfaces 52 in the opposite sides 46, 48 as illustrated in FIG. 2. The surface of the tray 42 may, if desired, also have a concave rising and falling surface for receipt of the pocket-springs.

Figure 3:
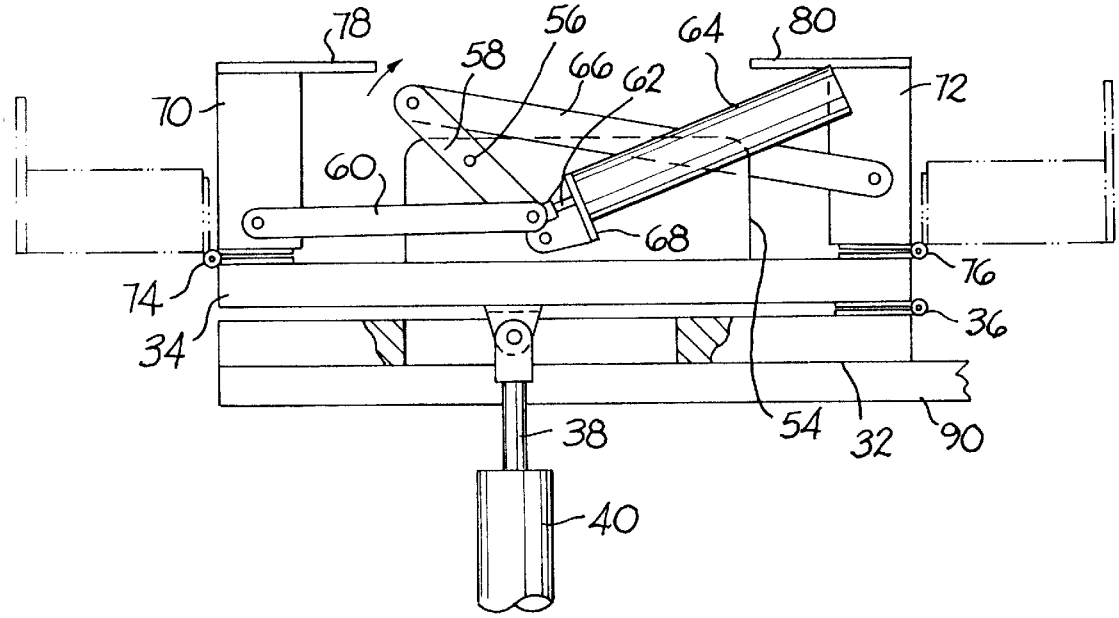
FIG. 3 is a side elevational view partly in section of the tray supporting table illustrating the jaws and the apparatus for actuating the jaws between the open and closed position relative to the tray.

Secured to at least one end, and preferably both ends, of the tray 42 is a bracket 54. Pivotally journalled on the bracket about a journal pin 56 intermediate its ends is a link 58 having a first end pivotally connected to a second link 60 and to a coupling on the end of the piston rod 62 of an pneumatic cylinder 64. The other end of the link 58 is pivotally connected to one end of a third link 66. The bracket 54 also journally mounts a small bracket 68 which secures the cylinder 64, the bracket 68 being pivotable slightly when the piston rod is moved. The second end of the link 60 is pivotally connected to the end of a first or outboard jaw 70 while the second end of the link 66 is pivotally connected to the end of a second or inboard jaw 72, each jaw being elongated and extending lengthwise of the table 32. As illustrated in FIG. 3, the jaw 70 is pivotally connected to the plate 34 by hinges 74 spaced lengthwise along the plate while the jaw 72 is pivotally connected to the plate 34 by similar hinges 76.

Figure 4:
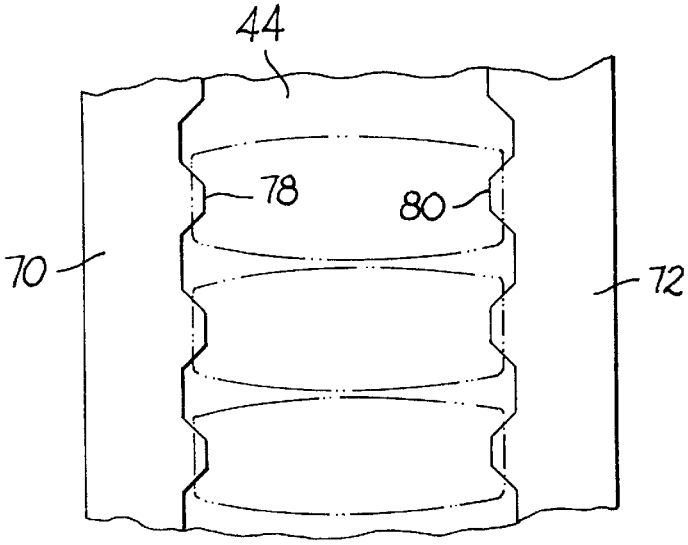
FIG. 4 is a top plan view of a portion of the tray and the jaws of the present invention illustrated in the jaws closed holding position.

Each jaw 70, 72 includes a respective plurality of spaced apart fingers 78, 80 which extend substantially normal to the base of the jaw, i.e., outwardly from the respective jaw and face toward the opposite jaw when the jaws are in the closed or upstanding position illustrated by the solid lines in FIG. 3 and which when the jaws are in the open position, illustrated in FIG. 2 and by the broken lines in FIG. 3, extend upwardly. The fingers 78, 80 may be similar in shape to the projections 50 or may be of a truncated triangular configuration as illustrated in FIGS. 2 and 4, or may be projections of any convenient configuration. Each of the fingers 78 and the fingers 80 are spaced apart in the longitudinally extending direction of the jaws by a distance substantially equal to the distance between the axes of adjacent coil springs 12 in a row of pocket-coils. The fingers 78 are aligned oppositely with corresponding fingers 80 to define a pair of cooperating fingers when the jaws are in the closed position and each pair of cooperating fingers are disposed substantially in alignment with the midpoint of the surfaces 52 between the projections 50 of the tray 42. In order to move the jaws 70, 72 to the closed position, illustrated in the solid line position of FIG. 3, the cylinder 64 is actuated to retract the rod 62, and to open the jaws, as illustrated in FIG. 2, the cylinder 64 is actuated to extend the rod 62.

The second station 30 includes a fixed table 82 disposed at an elevation above that of the table 32 by an amount such that when the plate 34 is pivoted to a vertical position relative to the table 32, a row of pocket-coils in the tray 42 will have the lower end of the pocket-coils at an elevation substantially at the level of the table 82, that lower end of the pocket-coils being the end adjacent the table 82 when the plate is in the horizontal position on the table 32. Secured to and depending downwardly from the table 82 at the rear thereof remote from the table 32 are a pair of spaced apart brackets 84, only one of which is illustrated in FIGS. 5–12, similar brackets 86 depending downwardly from the table 82 adjacent the front thereof. Each pair of brackets 84, 86 supports a hollow tube 88 of any conventional cross sectional configuration, such as a rectangular configuration, and which extends toward the front of the table 82. Slidably disposed within each tube 88 is a respective rod 90 of substantially the same cross sectional configuration as the tubes 88, the rods 90 extending forwardly under the table 32 and being secured thereto. Thus, the table 32 may be moved linearly toward and away from the table 82 guided by the rods 90 within the tubes 88. Secured to and extending between the rods 90 and secured to and extending between the exterior of the tubes 88 are respective narrow plates 92, 94 from which respective brackets 96, 98 depend downwardly intermediate the length of the plates 92, 94 so as to be substantially centrally disposed transversely beneath the tables 32 and 82. Connected to the bracket 98 is the rod end of a first pneumatic cylinder 100, while the rod end of a second pneumatic cylinder 102 is connected to the bracket 96, the opposite ends of the cylinders 100, 102 being connected together by a connecting member 104. The piston rod of one of the cylinders, such as cylinder 100, has a small stroke while the other cylinder, such as cylinder 102, has a larger stroke, for reasons hereinafter made clear, the small stroke being in the order of approximately one inch while the large stroke preferably being in the order of approximately 3.75 inches in an operative embodiment of the invention. Thus, the table 32 may be moved in two steps relative to the table 82.

Positioned on the table 82 and extending transversely is a slidable box 106 having a rectangular configuration with an open front 108, the opening having a height slightly larger than the height of the pockets and a length slightly longer than the length of the row of pocket-coils. The opening 108 in the box has a depth slightly less than the thickness of the pocket-coils, i.e., slightly less than the diameter of the coil springs 12 so that a row of pocket-coils may be received within the box with the surface of the pockets extending outwardly a small amount as illustrated in FIGS. 5 through 12. The box 106 has slide members or wheels 110 attached to the rear thereof at transversely spaced apart locations and each slide member or wheel is received within a guide slot 112 formed in the top of the table 82 for guiding the box slidably along the table. Thus, when one or both cylinders 100, 102 are actuated to retract the respective piston rods, the box may be moved along the table 82. However, the box is weighted so as to apply a frictional resistance so that it does not move when the first cylinder, i.e., cylinder 100, is actuated for bonding a row of pocket-coils to a row which is on the table, but will move when the cylinder 102 is actuated to move the pocket-coils on the table including a newly bonded row an amount substantially equal to the thickness or width of one row including the thickness of the elastomeric material 18, i.e., the diameter of the springs plus the thickness of the strip 18, as hereinafter described.

Figure 5:
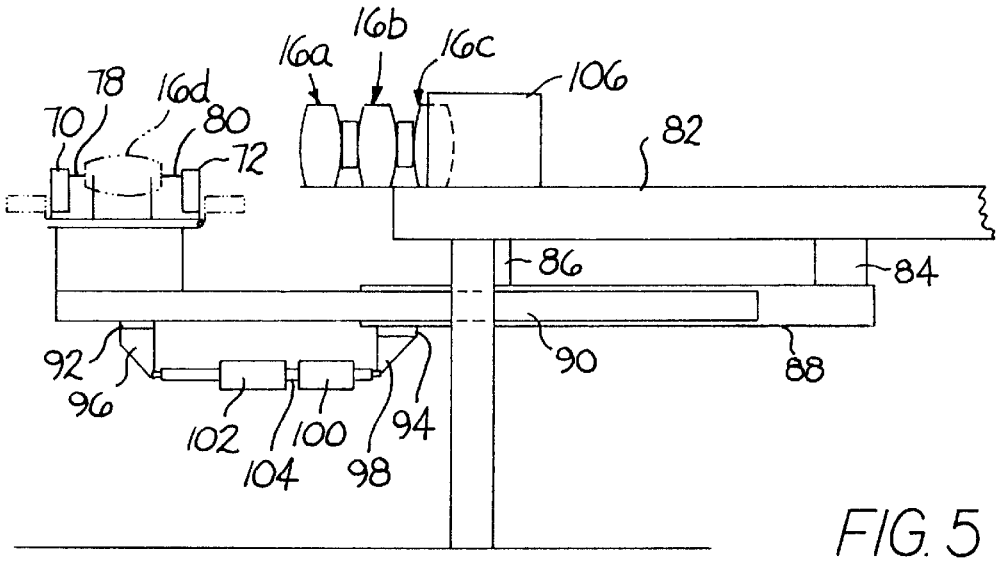
FIGS. 5 through 12 are diagrammatic representations of the apparatus illustrating the various steps in the method of the present invention.
Figure 6:
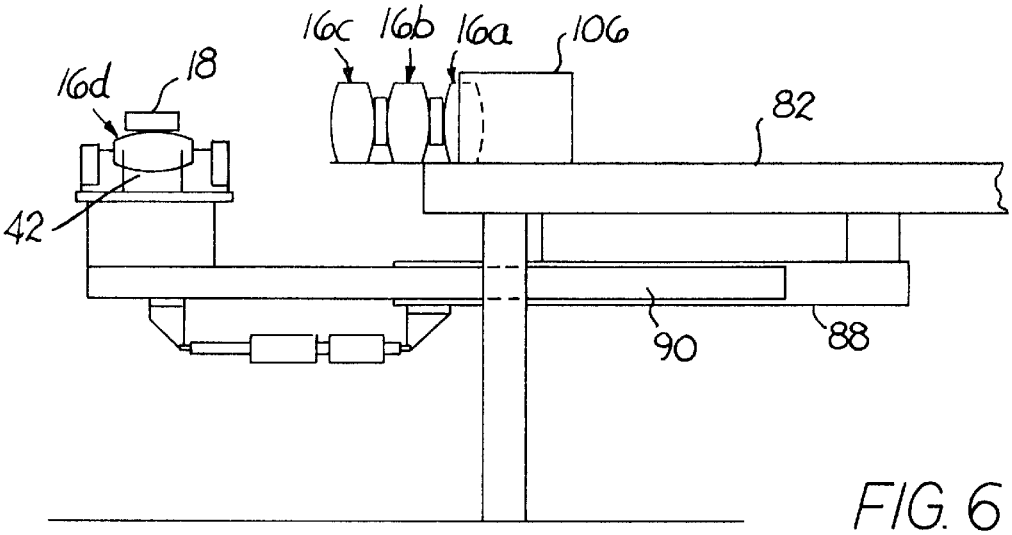

In operation and in practicing the method of the present invention, a row of pocket-coil springs, having between 12 and 26 springs per row depending upon the width of the mattress, is placed on the tray 42 as illustrated in FIG. 2. The cylinder 64 is actuated to withdraw the rod 62 to close the jaws 70, 72 and engage the respective fingers 78, 80 against the fabric at the ends of each coil pocket and thereby lock the row in the tray as illustrated in FIG. 5 with regard to row 16*d* without causing sagging of the material along the longitudinal surfaces of the pockets. The upper surface of the fabric of the row is sprayed with adhesive such as a hot-melt glue or solvent adhesive or the like and a strip 18 of the elastomeric foam material is placed on and pressed against the adhesive as illustrated in FIG. 6 to affix the strip 18 to the row 16*d*. The upper surface of the strip is then sprayed with adhesive and so to is the vertical surface of the last or previous row 16*c* standing on the table 82 outside of the box 106.

Figure 7:
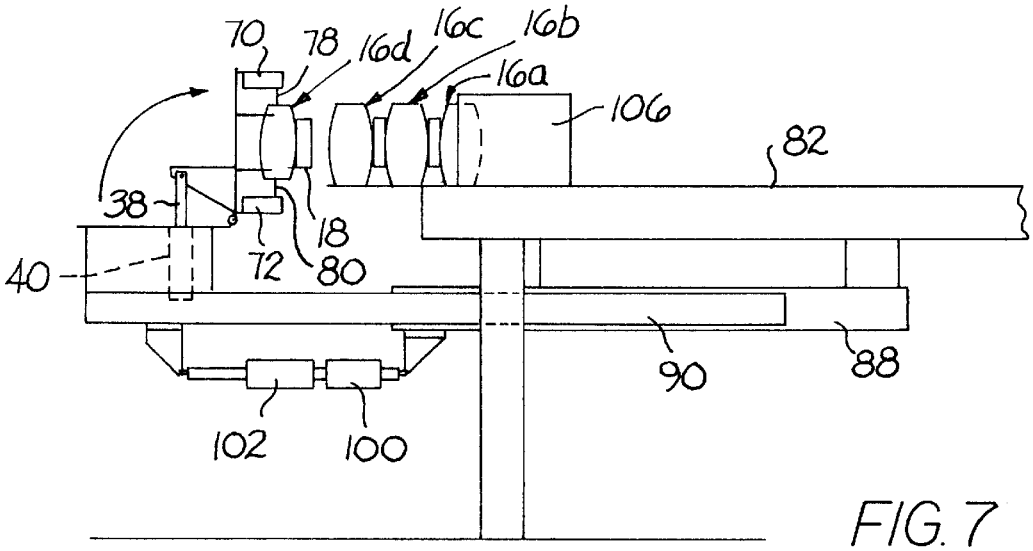
Figure 8:
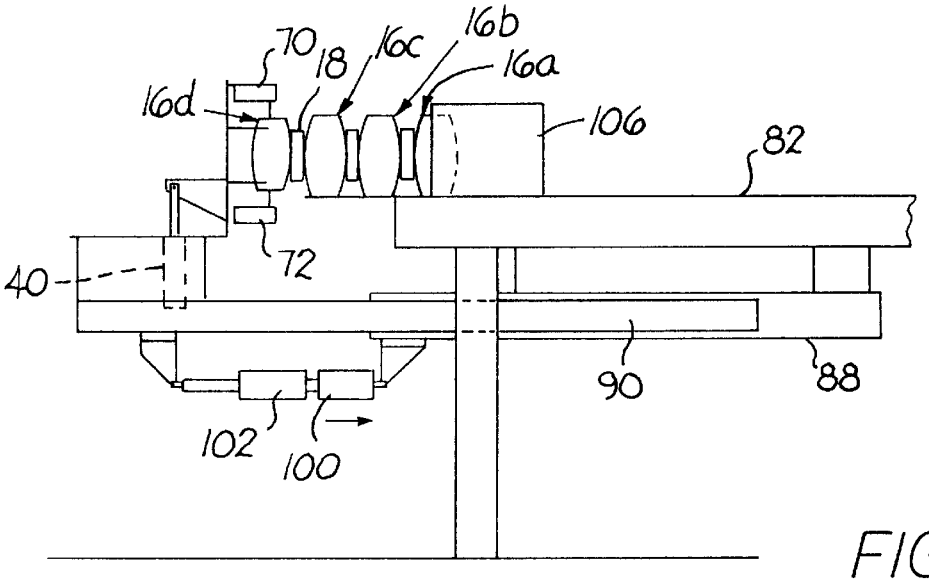
Figure 9:
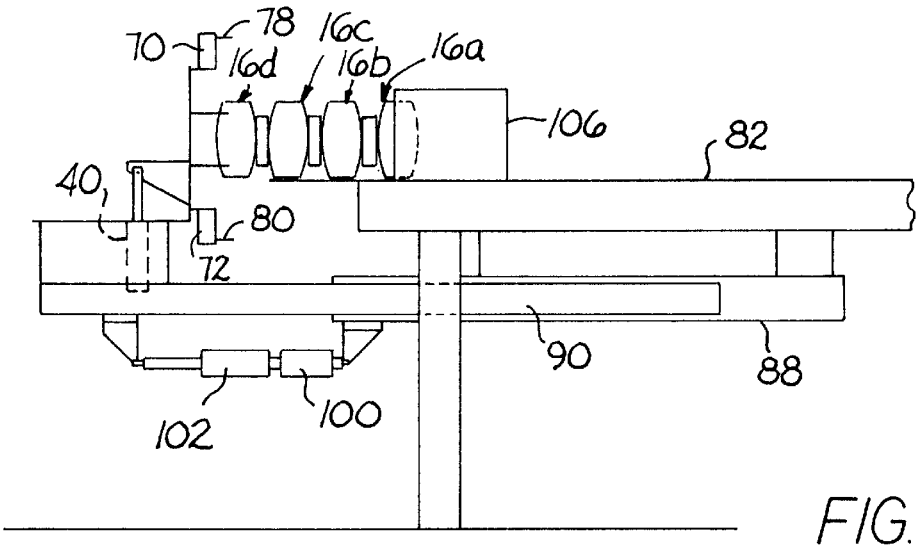
Figure 10:
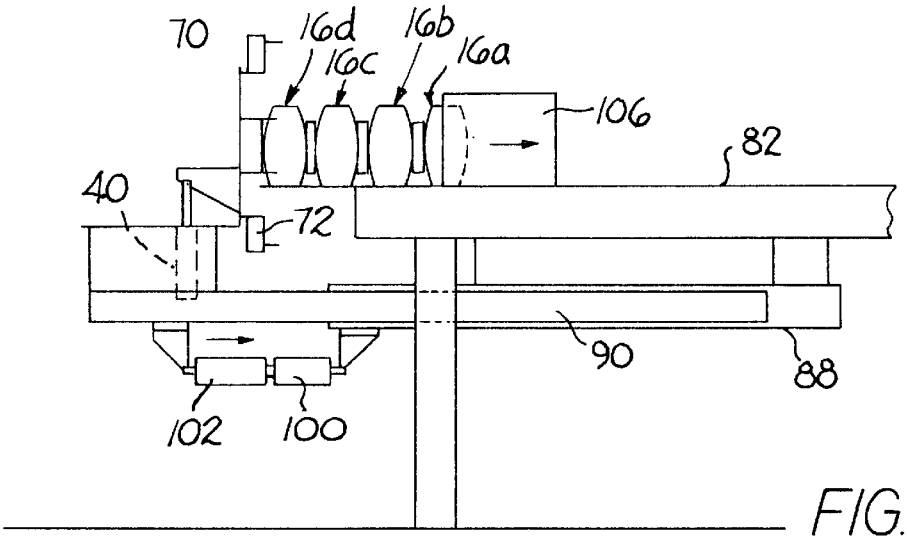
Figure 11:
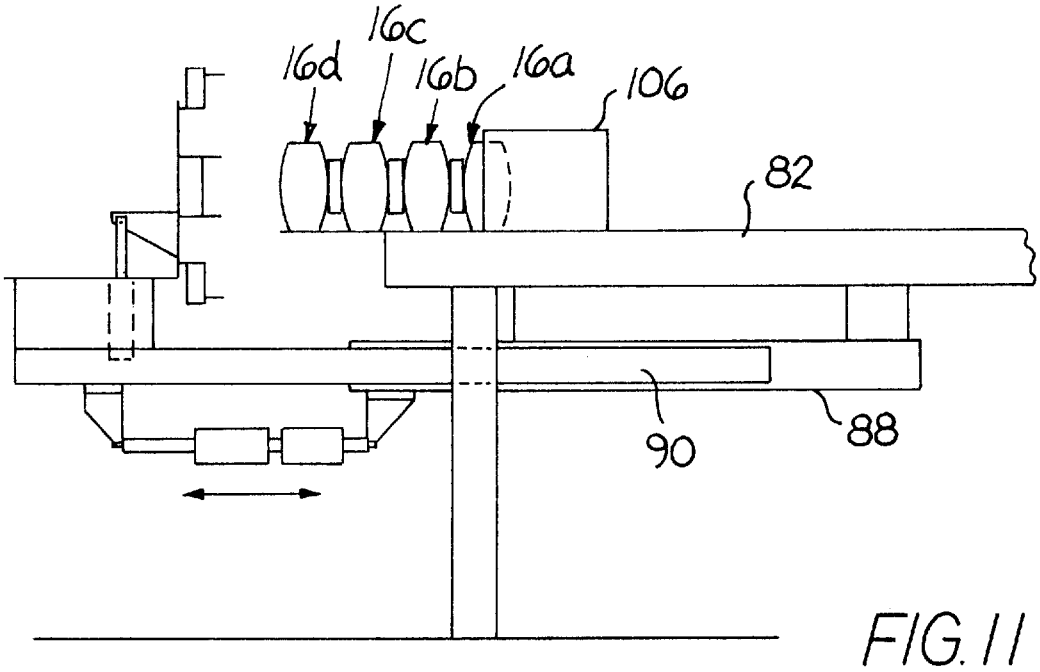
Figure 12:
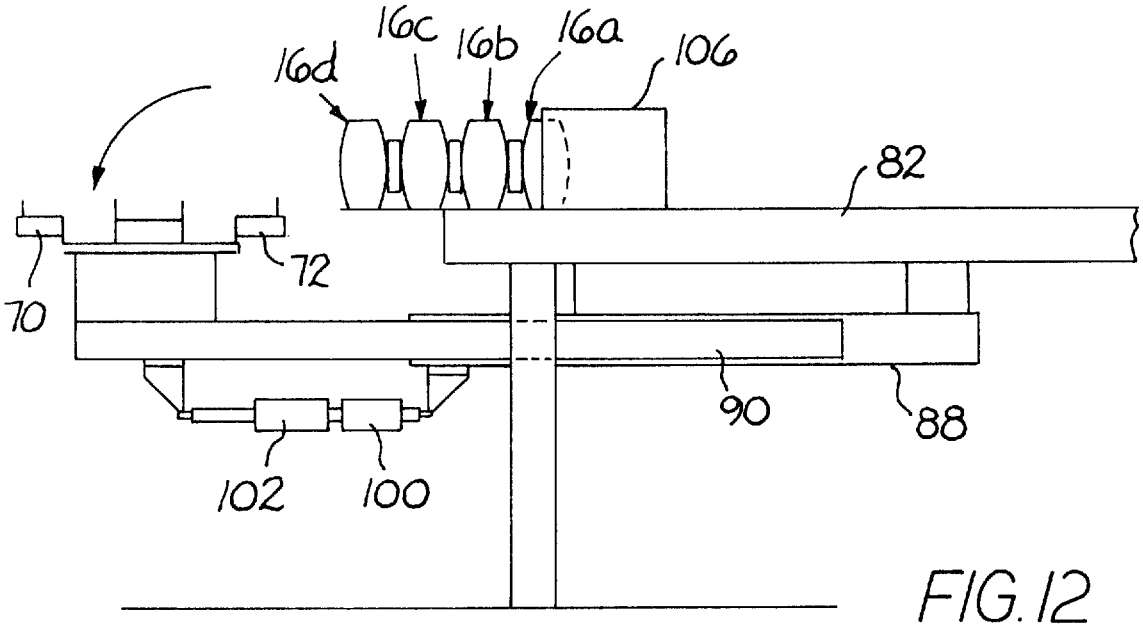

The cylinder 40 is thereafter actuated to extend the rod 38 and thereby pivot the plate 34 to the vertical position illustrated in FIG. 7 to align the row 16*d* vertically with the prior rows 16*a*, 16*b*, 16*c*, the first row 16*a* being disposed partly within the box 106. The cylinder 100 is then actuated to retract its piston rod and drive the table together with the plate 34, the tray 42 and the pocket-coil row 16*d* toward the table 82 and the row 16*c*, as illustrated in FIG. 8, the distance, as aforesaid, being approximately one inch so that the elastomeric strip 18 abuts the pocket row 16 to bond the strip 18 together with the pocket coils of row 16*d* to row 16*c*. The cylinder 64 is then actuated to extend the rod 62 and open the jaws 70, 72, as illustrated in FIG. 9, to release the row 16*d* of pocket-coils, the row 16*d* together with the strip 18 being secured to the row 16*c*. The cylinder 102 is then actuated to retract its piston rod and push the bonded rows 16*a*, 16*b*, 16*c*, 16*d* and the box 106 over the table against the friction of the box by a distance of one row including the strip 18 as illustrated in FIG. 10. The cylinders 100 and 102 are then actuated to extend the respective piston rods and move the table 32 together with the plate 34, the tray 42 and the jaws 70, 72 away from the table 82 to its original position, as illustrated in FIG. 11. The cylinder 40 is thereafter actuated to retract its piston rod to lower the plate 34 and tray to the initial position for repetition of the process until the number of rows on the table are substantially equal to the length of the mattress to be formed. Thereafter, the mattress is finished as aforesaid with the border rods 20, the felt material 22, the pads 24 and the upholstered covering 26.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for forming a mattress having a core comprising a plurality of elongated rows of interconnected coil spring containing fabric pockets, each row having a plurality of spaced apart pockets with a spring encased in each pocket, each of said coil springs being coiled in helical form about an axis of elongation including opposite ends spaced apart along said axis, said apparatus comprising an elongated tray having pocket supporting surface means for receiving and supporting a row of spring containing fabric pockets with the axes of said springs disposed transverse to the direction of elongation of said tray, a pair of spaced apart elongated jaws, each of said jaws having a plurality of fingers spaced apart in the direction of elongation of said jaws, the spacing between adjacent fingers of each jaw being substantially equal to the spacing between the axes of adjacent springs in said row, means for pivotally mounting each jaw to said tray for movement from an open position wherein said fingers are spaced laterally from said pocket supporting surface means for permitting a row of spring containing fabric pockets to be inserted into said tray to a closed position wherein the fingers of one jaw are aligned with and face the fingers of the other jaw for engaging said fabric of the pockets covering said opposite ends of said springs to grasp and hold said row in said tray, and means for moving said jaws from said open position to said closed position selectively.

2. Apparatus as recited in claim 1, including means for mounting said tray for movement about a pivot axis from a first position for receiving a row of spring containing fabric pockets to be held by said fingers to a second position for releasing said fingers from said row.

3. Apparatus as recited in claim 2, wherein said fingers are disposed substantially vertically when said tray is in said first position and said fingers are disposed substantially horizontally when said tray is in said second position.

4. Apparatus as recited in claim 3, wherein said tray is disposed substantially horizontally in said first position and said tray is disposed substantially vertically in said second position.

5. Apparatus as recited in claim 3, wherein said pocket supporting surface means are disposed in vertical planes when said tray is in said first position, and said pocket supporting surfaces are disposed in horizontal planes when said tray is in said second position.

6. Apparatus as recited in claim 5, wherein said pocket supporting surface means comprise a plurality of concave surfaces.

7. Apparatus as recited in claim 2, including means for mounting said tray for movement in a direction transverse to the direction of elongation of said jaws, a table spaced transversely to said direction of elongation for supporting a plurality of elongated rows of interconnected coil spring containing fabric pockets at an elevation corresponding to the row carried by said tray when said tray is in said second position, and drive means for moving said tray in said transverse direction selectively towards the table for abutting and bonding an elastomeric strip of material adhesively bonded on the surface of said fabric of the row in said tray to a prior row disposed on said table and for pushing all the rows on the table further onto the table a distance substantially equal to one row of pockets plus the thickness of one strip.

8. Apparatus as recited in claim 7, wherein said drive means comprises a first pneumatic cylinder for moving said table to bond said strip of material to said prior row and a second pneumatic cylinder for pushing all said rows on the table.

9. Apparatus as recited in claim 7, wherein said fingers are disposed substantially vertically when said tray is in said first position and said fingers are disposed substantially horizontally when said tray is in said second position.

10. Apparatus as recited in claim 9, wherein said tray is disposed substantially horizontally in said first position and said tray is disposed substantially vertically in said second position.

11. Apparatus as recited in claim 10, wherein said pocket supporting surface means comprise concave surfaces disposed in vertical planes when said tray is in said first position, and said concave surfaces are disposed in horizontal planes when said tray is in said second position.

12. Apparatus as recited in claim 7, including means disposed on said table for applying resistance against the pushing of said rows on the table.

13. Apparatus as recited in claim 12, wherein said fingers are disposed substantially vertically when said tray is in said first position and said fingers are disposed substantially horizontally when said tray is in said second position.

14. Apparatus as recited in claim 13, wherein said tray is disposed substantially horizontally in said first position and said tray is disposed substantially vertically in said second position.

15. Apparatus as recited in claim 13, wherein said pocket supporting surface means comprise concave surfaces disposed in vertical planes when said tray is in said first position, and said concave surfaces are disposed in horizontal planes when said tray is in said second position.

* * * * *